United States Patent [19]

Nakanishi et al.

[11] 4,050,050

[45] Sept. 20, 1977

[54] ADJUSTABLE POTENTIOMETER ASSEMBLY

[75] Inventors: Mutsuo Nakanishi, Villa Park; Hans Schmidt, Schiller Park, both of Ill.

[73] Assignee: Matsushita Electric Company of America, Franklin Park, Ill.

[21] Appl. No.: 580,541

[22] Filed: May 27, 1975

[51] Int. Cl.[2] ..... H01C 10/48

[52] U.S. Cl. ..... 338/190; 338/127; 338/128; 338/162; 338/185

[58] Field of Search ..... 338/122-124, 338/127, 128, 134, 160, 162, 185, 190, 202

[56] References Cited

U.S. PATENT DOCUMENTS

| | | | |
|---|---|---|---|
| 2,498,967 | 2/1950 | Schaefer | 338/124 X |
| 2,934,731 | 4/1960 | Cotton | 338/128 |
| 2,950,455 | 8/1960 | Brown | 338/134 |
| 3,519,973 | 7/1970 | Louis et al. | 338/162 |

*Primary Examiner*—C. L. Albritton

*Attorney, Agent, or Firm*—Drummond, Nelson & Ptak

[57] ABSTRACT

A potentiometer assembly particularly suited for supplying tuning voltages for all of the bands of signals capable of receipt by a television receiver or the like, includes three segments of resistive material arranged in a circle on a support member. Each of the segments corresponds to a different band of frequencies to which the television receiver may be tuned. Band selection is effected by comparable conductive segments on the support member.

In one embodiment, a single wiper is used to sweep all of the resistive segments to supply the desired tuning voltage output. A cam arrangement is used to adjust the detented position of the wiper relative to the support member to effect fine tuning at each position. Other embodiments utilize individually adjustable wipers for each station or detent position of the tuner, with each wiper being preset to effect the fine tuning at the detented position of the potentiometer assembly. The individual contacts or wipers for each position are arranged to overlap comparable resistances on the resistive material, so that the entire range of tuning voltages which appear across the resistive material is available from the outputs of the assembly.

21 Claims, 20 Drawing Figures

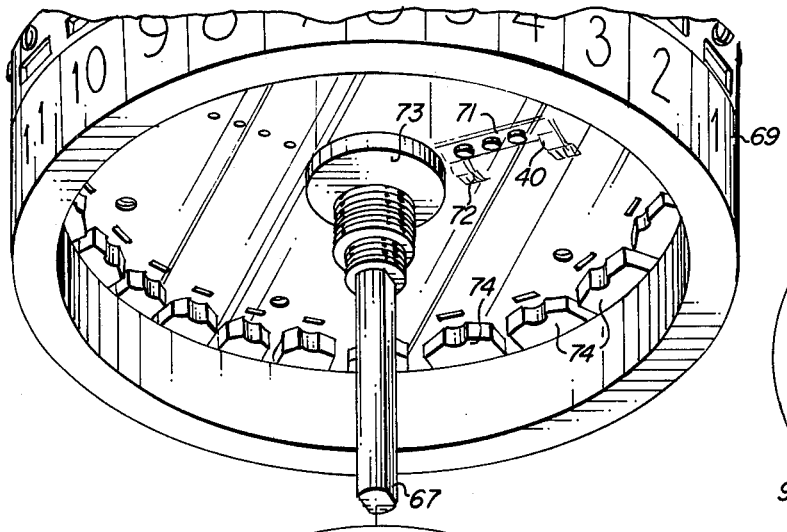
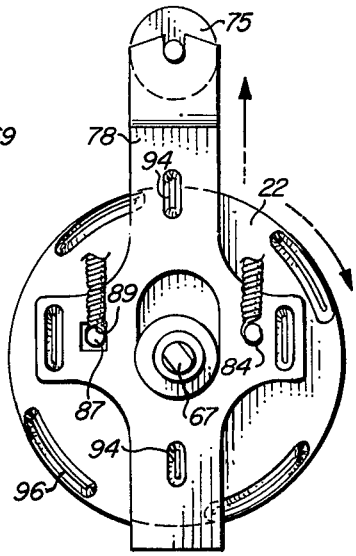
FIG-14
FIG-15
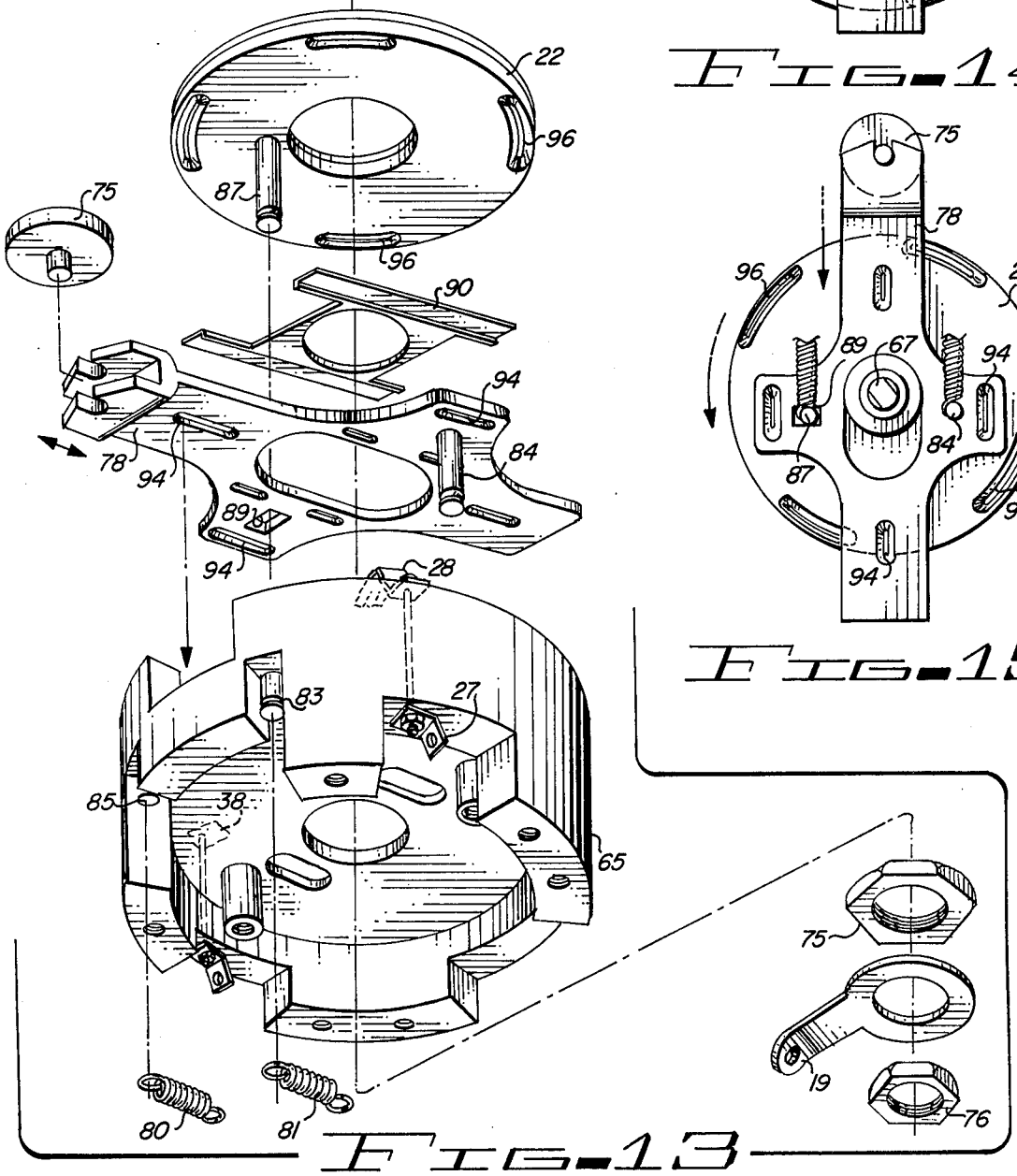
FIG-13

ADJUSTABLE POTENTIOMETER ASSEMBLY

BACKGROUND OF THE INVENTION

This invention relates to potentiometer assemblies, and more particularly to a novel potentiometer assembly suitable for producing tuning voltages for use with electronic tuners of television receivers and the like.

For many years, mechanical turret tuners have been commonly employed in television receivers to select the VHF channels, and a second rotary or continuous tuner has been used to select the UHF channels. For most television receivers, this requires two different channel selection knobs; and the tuners themselves are relatively bulky and require a relatively large amount of space within the television receiver cabinet. Because of the nature of these tuners, it also is necessary to locate them directly behind the front panel of the receiver cabinet. This imposes significant restrictions on the cabinet design and the arrangement of parts within the cabinet. As a consequence, design flexibility in the arrangement of the parts in the television chassis is considerably restricted.

Some mechanical tuners are equipped with programmable switches to permit them to be used to select either a UHF or a VHF channel at a tuner position by programming the tuner for the local area where the television receiver is to be used. The disadvantages of the cumbersome mechanical tuners are not overcome by such programmable arrangements, however. Instead, the tuner is made even more complicated.

It is desirable, and in the United States it is becoming necessary, to effect selection of the UHF and VHF channels in a comparable manner. When such tuning compatibility is imposed, significant problems are encountered in a mechanical turrent-type tuner having detented positions for accommodating the VHF channels and all of the possible UHF channels which a receiver is capable of receivng in any given locality in which it is operated.

The introduction of voltage variable capacitor or varactor tuners for the VHF and UHF bands to which a television receiver can be tuned has opened the way for electronic tuning of television recievers. This permits replacement of the cumbersome mechanical turret tuners with arrangements which permit greater flexibility in the design of the channel selection panel and in the location of the various tuner parts within the receiver cabinet. If the receiver, however, is to be made capable of individual selection of a large number of the 70 UHF channels in addition to the VHF channels, it has been necessary to provide a large number of individual tuning components. For example, in many prior art electronic tuner control circuits, it has been necessary to provide a separate tuning potentiometer for each of the UHF channels and each of the VHF channels to which the receiver can be tuned. This results in a relatively expensive tuner configuration requiring a large number of parts.

It is desirable to provide a television tuning control system which is capable of tuning to any channel which the receiver can receive with equal ease of selection of VHF or UHF channels. In addition, it is desirable to provide a tuner control system which uses a minimum number of parts, facilitates fine tuning adjustments, which is compact in size, and is relatively inexpensive.

SUMMARY OF THE INVENTION

Accordingly, it is an object of this invention to provide an improved potentiometer assembly.

It is another object of this invention to provide an improved tuner control assembly.

It is an additional object of this invention to provide an improved tuner control system for a multi-band radio frequency receiver, such as a television receiver.

It is still another object of this invention to provide a tuner control system for a television receiver which is capable of tuning to any channel in the UHF and VHF bands.

It is a further object of this invention to minimize the number of components required to provide VHF and UHF channel selection in a fully compatible television tuner.

It is yet another object of this invention to provide a potentiometer assembly for a tuner control system in which the potentiometer elements comprise a single, segmented, resistive element, each segment corresponding to a different band of frequencies to which the receiver with which the assembly is used can be tuned.

In accordance with a preferred embodiment of the invention, an adjustable potentiometer assembly includes a flat, multiple-segment, resistive element across which direct current is applied. An adjustable tap means is mounted in the potentiometer assembly and has at least one tap member for selecting any desired available voltage from any of the segments of the resistive element out of the full range of voltages which each segment is capable of producing. The relative position of the tap member and the resistive element are adjusted to select the desired output voltage.

In more specific embodiments, the resistive element is in the form of a circular arrangement of segmented arcs of resistive material; and the adjustable tap member includes a plurality of adjustable potentiometer tap members for each segment of the resistive material. Each of the adjustable tap members are arranged to traverse a pre-established different portion of each segment of the resistive element to obtain a voltage therefrom which is variable in a limited range. Adjacent ones of the tap members are arranged for overlapping common resistance portions of the resistive elements to permit selection of any desired available voltage from the resistive elements out of the full range of voltages which the potentiometer assembly is capable of producing.

BRIEF DESCRIPTION OF THE DRAWINGS

FIG. 13 is an exploded view of the assembly of FIG. 9;

FIGS. 14 and 15 illustrate different operating positions of a portion of the assembly shown in FIGS. 10 and 13;

FIG. 18 is an exploded view of a fine tuning adjustment structure for use with an element of the type shown in FIG. 16.

DETAILED DESCRIPTION

Throughout the various figures of the drawings, the same reference numbers are used to designate the same or similar components.

Figure 1:
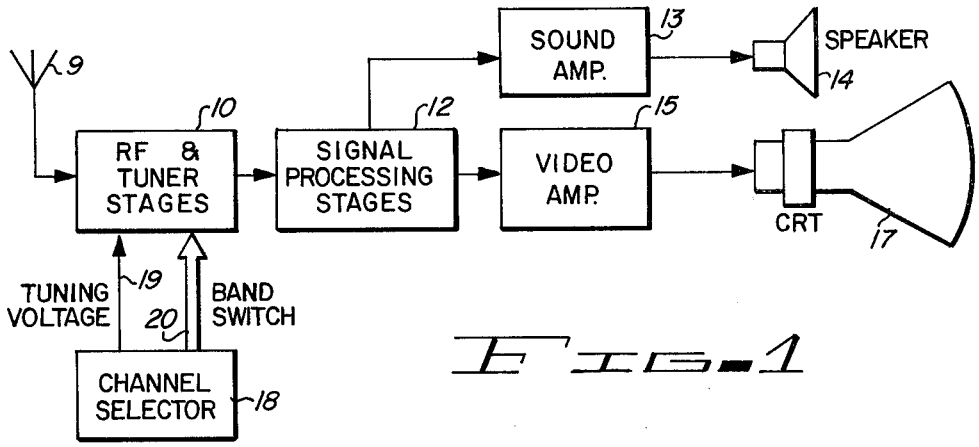
FIG. 1 is a schematic diagram, in block form, showing a television receiver with which the potentiometer assembly according to preferred embodiments of this invention may be used.

Referring now to FIG. 1, there is shown a block diagram of a television receiver of the type with which channel selection by the potentiometer assemblies of the preferred embodiments of the invention may be used.

The VHF and UHF television signals are received on an antenna 9 and are applied to the RF and tuner stages 10 of the receiver. The tuner stages preferably are electronic tuners using voltage variable capacitors or varactors for tuning to any one of the VHF and UHF channels in both of the VHF bands of frequencies and in the UHF frequency band. The output of the RF and tuner stages 10 comprises the properly tuned IF output signals, which are supplied to signal processing stages 12 of a conventional black and white or color television receiver. The stages 12 in turn supply the signals to a sound amplifier circuit 13 to drivea loudspeaker 14. In addition, output signals from the processing stages 12 are supplied to video amplifier stages 15 which supply signals to a cathode ray tube 17 for reproduction of the video images of the received composite television signal.

A channel selector 18 is used to tune the receiver to the particular channel which the viewer wishes to observe on the cathode ray tube 17 and hear on the loudspeaker 14. To accomplish this, the channel selector circuit supplies a direct current tuning voltage over a lead 19 to the tuners in the RF and tuner stages 10. In addition to the tuning voltage applied over the lead 19, a band selection signal is applied over a lead or leads 20 to the RF and tuner stages 10 to enable for operation the appropriate section of the tuner utilized to respond to the channels in a particular one of the three bands of signals to which the television can be tuned.

Figure 2:
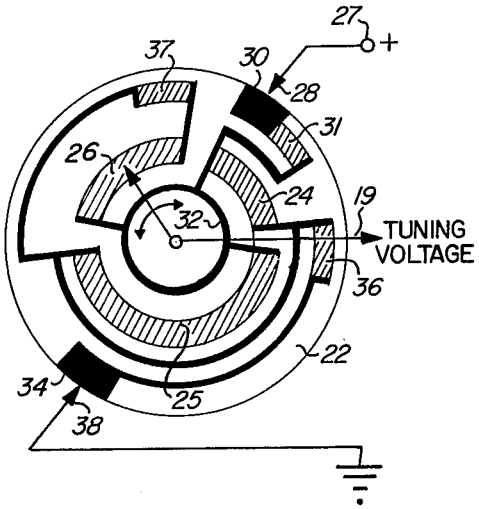
FIG. 2 is a plan view of a potentiometer resistive element, with corresponding conductive connections thereto, as used in a potentiometer assembly according to a preferred embodiment of the invention.

In FIG. 2, there is shown a preferred form of a potentiometer resistive element which may be used in the channel selector 18 in different assemblies for providing the required tuning voltages on the lead 19. This element also can be used to supply information over the band switch leads 20 to the RF and tuner stages 10 of the receiver.

The potentiometer resistive element in FIG. 2 is formed on a circular support member 22 which is made of insulating material, such as commonly employed in printed circuit boards and the like. Resistive elements in the form of three arcuate segments 24, 25 and 26, corresponding to the low band VHF, UHF, and high band VHF television channels, respectively, are deposited on or otherwise attached to the support member 22. The segments 24, 25 and 26 all lie in the same circle and have the same inner and outer radii to define their widths. The resistive segments 24, 25 and 26 may be formed in accordance with standard printed circuit or microelectronic techniques and have a substantially flat upper surface.

B+ operating potential for the segments 24, 25 and 26 is applied from a suitable source (not shown) to a voltage supply terminal 27. This terminal in turn is coupled to a contact member 28 which makes electrical contact with a conductive area 30 deposited or otherwise attached to support member 22. As shown in FIG. 2, the electrical conductive area 30 is connected through a deposited resistive area 31 to a common conductor 32 connected to one end of each of the resistive segments 24, 25 and 26. This constitutes the B+ supply to each of these resistive segments.

The other end of each of the resistive segments 24, 25 and 26 is connected to another conductive area 34 by means of additional conductors on the support member 22. As shown in FIG. 2, the resistive segments 24 and 25 are connected to the conductive area 34 througha deposited resistor 36; and the resistive segment 26 is connected to the terminal 34 through a deposited resistor 37 and the deposited resistor 36. This is necessary to supply tuning voltages in the proper ranges from these various segments representative of the different bands to which the television receiver can be tuned. The supply voltage connections for the resistive segments shown in FIG. 2 are completed by making a connection to ground through conductive contact member 38 on the conductive area 34.

The tuning voltage on the lead 19 may be obtained from any of the resistive segments 24, 25 or 26 by a rotating brush 40, which is shown as capable of rotation through a full 360° circle. The brush or wiper 40 is capable of making contact with any point on any of the resistive segments 24, 25 and 26. This makes it possible to tune the television receiver of FIG. 1 to any channel in any band which it is capable of receiving. The subassembly of FIG. 2 can be used in a variety of different channel selection mechanisms.

One type of channel selection mechanism which utilizes the subassembly of FIG. 2 is a push-button channel selection assembly, as shown in FIGS. 3 through 8. In the structure shown in these figures, the potentiometer resistor subassembly of FIG. 2 is mounted in a fixed position on a suitable base member (not shown) which may be of any suitable desired configuration. Each of the 12 VHF channels in the two VHF frequency bands and twelve channels in the UHF frequency band are individually pretuned by the adjustment of a corresponding potentiometer wiper 42, one of which is provided for each channel.

The wipers 42 each are pivotally mounted at one end on an adjustment screw 43 (shown most clearly in FIGS. 5, 7 and 8) for semi-circular rotation across a selected area of the arcuate resistive segment 24, 25 or 26 with which each wiper 42 is associated. The wipers 42 are located in a staggered relationship on opposite sides of the segments 24, 25 and 26, so that adjacent wipers 42 are capable of overlapping points of common resistance (and therefore are capable of producing overlapping output voltages) on the resistive segments. The lengths of the wipers 42 are chosen so that they do not contact one another or interfere with the movement of adjacent wipers.

By arranging the wipers 42 in this manner, it is possible to fine tune all of the channels which are to be selected by the channel selector 18 and to produce any tuning voltage from the wipers 42 on the appropriate output lead or conductor connected to it which is capable of being obtained from the corresponding resistive segment 24, 25 or 26.

Figure 5:
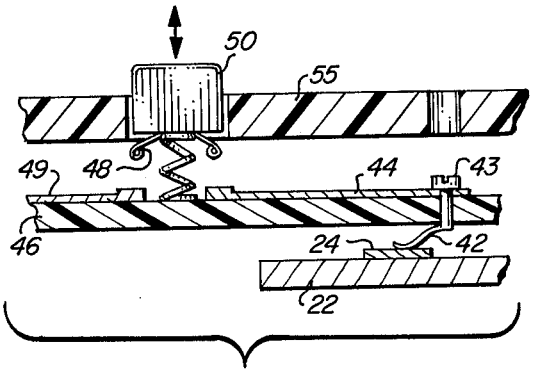
FIG. 5 shows details of the push-button switch arrangement and assembly of FIGS. 3 and 4.

Each wiper 42 makes an electrical contact with the resistive element with which it is associated, through its conductive adjustment screw 43. Each screw 43 in turn is in electrical contact with a corresponding conductor 44 mounted on a supporting plate 46. The plate 46 is located above the surface of the resistive element support 22 as shown in FIG. 5. The wipers 42 extend below the plate 46, and the lead of the adjustment screws 43 and the conductors 44 are on the opposite side of the plate 46.

Figure 3:
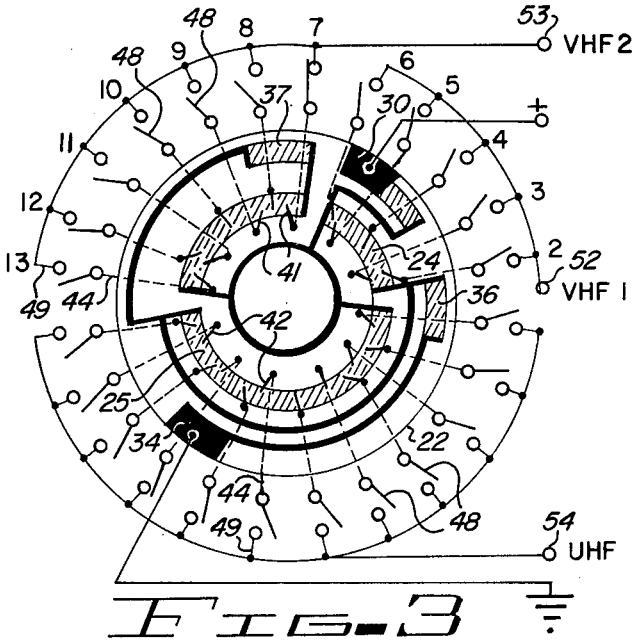
FIG. 3 shows one arrangement of circuit interconnections which can be used with the resistive element of FIG. 2.
Figure 4:
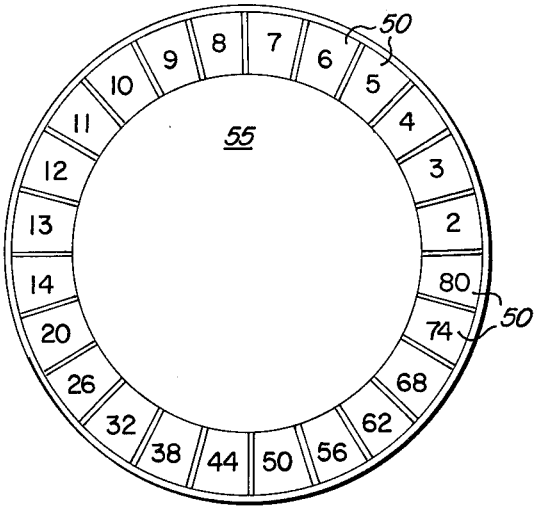
FIG. 4 illustrates a pushbutton switch overlay which can be used in conjunction with the arrangement of FIG. 3.

Selection of a particular channel in the channel selector 18 is effected by closing an appropriate one of the channel selector switches 48, which are indicated in FIG. 3 around the periphery of the support member 22. As shown in FIGS. 4 and 5, these switches 48 preferably are actuated by push-buttons 50, and the circular arrangement of push-buttons in FIG. 4 overlies the contacts shown in FIG. 3 to permit selection of the twelve VHF and twelve UHF channels to which the different wipers 42 are adjusted.

When one of the switches 48 is closed, the potential or voltage picked up by the corresponding wiper 42 from its corresponding resistive element 24, 25 or 26 is appliedthrough the closed switch to the appropriate VHF 1, VHF 2, or UHF output terminal 52, 53 or 54 shown in FIG. 3. This constitutes the desired tuning voltage for the selected channel. Any tuning voltage appearing on one of the terminals 52, 53 or 54 also is indicative of the selected band. The tuning voltages obtained from the terminals 52, 53 and 54 of FIG. 3 can all be applied through isolating diodes in common to a tuning voltage lead 19 as shown in FIG. 1. In addition, the presence of any voltage on one of the terminals 52, 53 and 54 can be applied over corresponding independent band switch leads 20 to select the proper band for operation of the tuner in the RF and tuner stages 10 of the circuit of FIG. 1.

FIG. 5 shows a typical configuration for the push-button assembly which can be used. The push-buttons 50 may be mounted on a push-button support plate 55 which overlies the conductor support plate 46. When a selected push-button 50 is depressed, a conductive bridging contact 48 completes an electrical connection between the selected lead 44 for the channel to which the receiver is to be tuned and an output lead 49. The output leads 49 then are each connected to one of the output terminals 52, 53 or 54 for the appropriate frequency band to complete an electrical connection from the wiper 42 for the selected channel with the appropriate output terminal. The circular push-button arrangement of FIG. 4 is used for purposes of illustration only and is intended to be restrictive. For example, the push-button switches 50 could be arranged in any suitable configuration, such as a rectangular block, with the leads 44 and 49 electrically interconnected as described, but physically arranged in different patterns.

Figure 6:
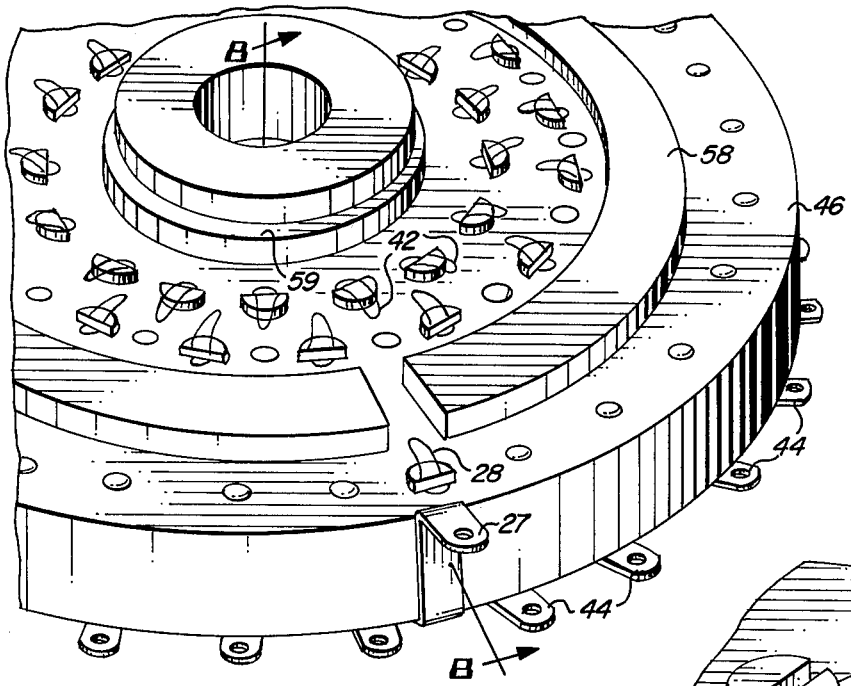
FIG. 6 is a perspective view of a portion of an assembly of the type shown in FIG. 3.
Figure 7:
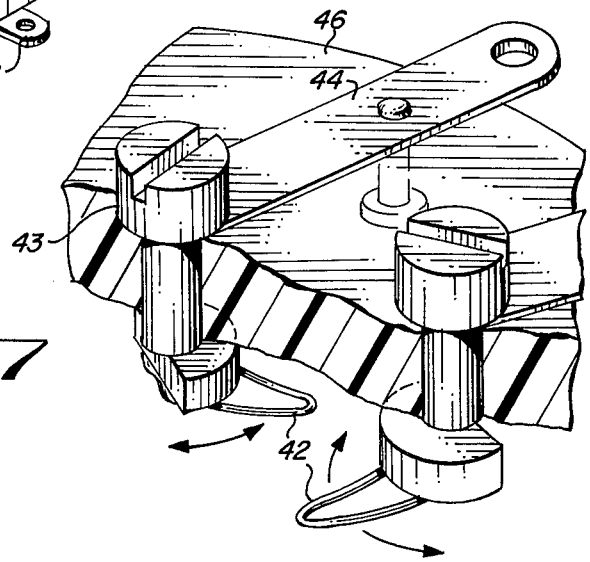
FIGS. 7 and 8 show details of the assembly of FIG. 6.
Figure 8:
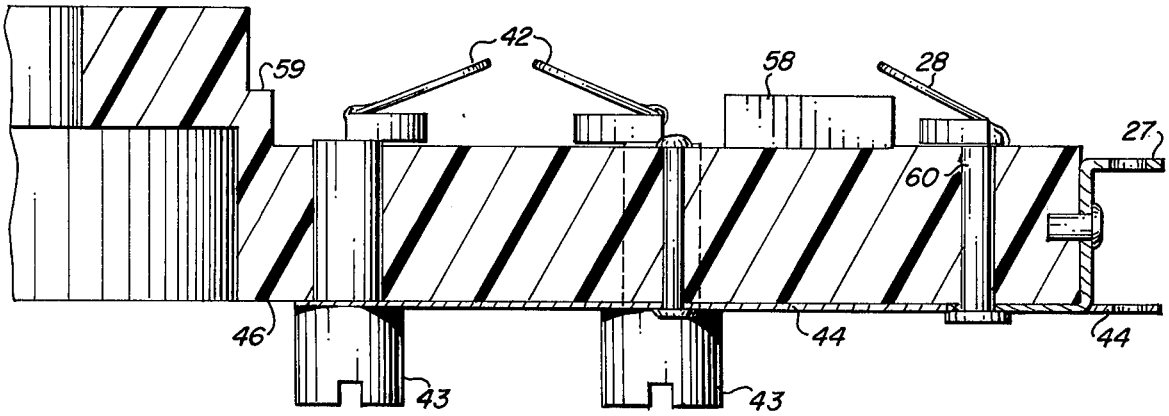
Figure 9:
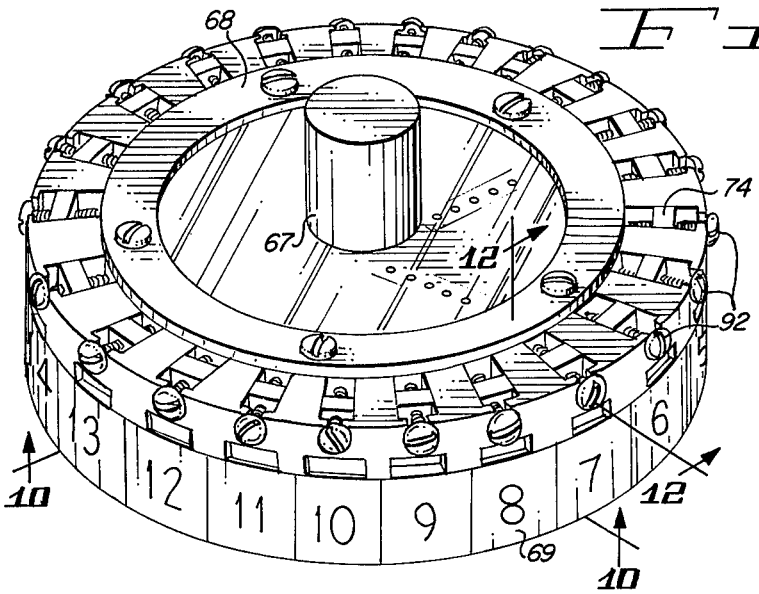
FIG. 9 is a perspective view of another embodiment of the invention using a resistive element of the type shown in FIG. 2.
Figure 10:
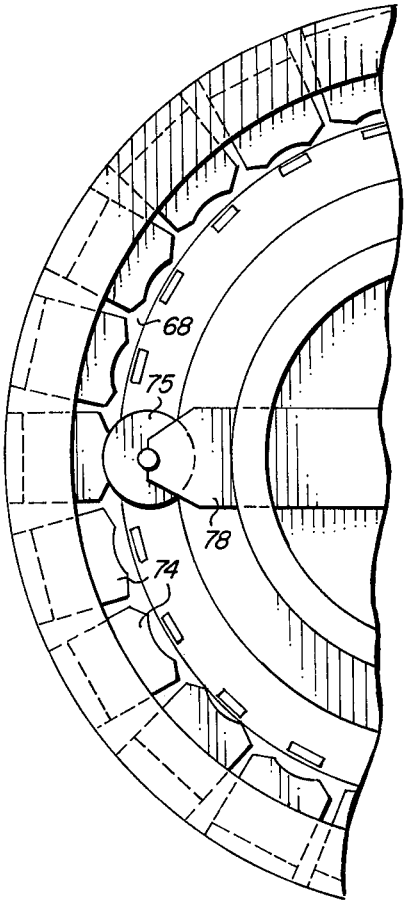
FIG. 10 is a partial cutaway view of the assembly of FIG. 9.
Figure 11:
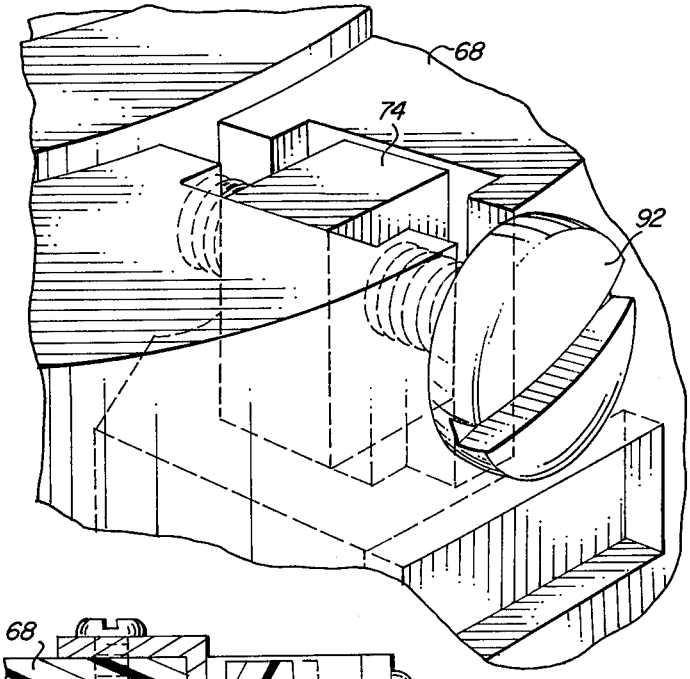
FIG. 11 is an enlarge detail view of a portion of the assembly of FIG. 9.

FIGS. 6, 7 and 8 show additional details of the portion of the support plate 46 on which the conductors 44, adjustment screws 43 and wipers 42 are mounted. In order to properly space the plate 46 from the support member 22 on which the resistive segments are deposited, a spacer ridge 58 and a spacer shoulder 59 are integrally formed as part of the support place 46. The support member 22 is then firmly engaged by suitable means, not shown, with the spacer ridge 58 and shoulder 59 to cause the wipers 42 to resiliently engage the resistive elements 24, 25 and 26. The wipers 42 are made of spring material which is pressed downwardly, as viewed in FIG. 8, by the support member 22 to cause them to make good electrical contact with the resistive elements 24, 25 and 26. Also shown in FIGS. 6 and 8 is the contact 28, which is made of spring material in the same configuration as the wipers 42. This contact is electrically connected through a conductive rivet 60 to the supply terminal 27.

Referring now to FIGS. 9 through 15, there is shown another embodiment of the invention using the subassembly of FIG. 2. In contrast to the embodiment shown in FIGS. 3 through 8, however, the channel selection potentiometer assembly of FIGS. 9 through 15 employs relative movement between the subassembly of FIG. 2 and a single wiper or brush for supplying the output tuning voltage on the lead 19 (FIG. 1).

Reference first of all should be made to the exploded view in FIG. 13. A base member 65 is attached in a fixed position to a suitable point in the chassis of the television receiver. The voltage supply terminal 27 and the supply contacts 28 and 38 for making contact between a source of B+ supply and the resistive elements on the support members 22 are shown in their actual physical positions.

Each of the 12 VHF and 12 UHF channels are selected by detent tuning effected through rotation of a channel selection shaft 67 in either direction. A cam support block 68 (most clearly shown in FIGS. 9 through 12) is attached to the channel selection shaft 67 for rotation with it. The other periphery of the circular-shaped cam support block 68 has a depending portion forming a channel indicia ring 69 displaying the selected channel number to a suitable viewing position. The underside of the cam support block 68 carries a potentiometer wiper 40 on it making electrical contact with the resistive segments 24, 25 and 26 formed on the upper surface of the support member 22 as viewed in FIGS. 13, 14 and 15. The manner in which this is done has been described previously in conjuction with FIG. 2.

The potentiometer wiper 40 is formed as an integral part of a contact member 71, which includes an additional wiper 72 located near the inside or center of the cam support block 68. This wiper 72 is arranged to be in conductive contact with an additional circular metal ring (not shown) placed on the upper surface of the support member 22 (as viewed in FIG. 13) as a common contact.

Electrical contact between a metal retaining disc 73 and the metal ring on the support member 22 provides a common connection between the potential sensed by the wiper 40 and the member 73. The shaft 67 also is made of conductive material and is in electrical contact with the member 73. Conductive threaded fasteners 75 and 76, shown in the lower right hand portion of FIG. 13, fasten the assembly together to provide electrical continuity between the wiper 40 and an output terminal member 19. The terminal member 19 corresponds to the tuning voltage lead 19 of FIG. 1. The voltage appearing on the terminal 19 is the voltage selected by the wiper 40 from its position on any one of the arcuate resistive segments 24, 25 and 26 on the support member 22.

Each detented channel position is selected by rotation of the channel selection shaft 67 under the control of a suitable tuning knob (not shown) to move a corresponding adjustable cam and detent member 74 for the selected channel position into engagement with a cam follower wheel 75 carried on the end of a reciprocating cam follower lever 78. The lever 78 is resiliently biased into engagement with the adjustable cams 74 by means of a pair of coil springs 80 and 81. The spring 81 stretches between a spring mounting post 83 secured to the base member 65 and a spring support post 84 carried on the cam follower lever 78. In a similar manner, the spring 80 stretches between a spring support post 85 secured to the base member 65 and a fine tuning adjustment post 87 rigidly attached to the underside of the support member 22.

The post 87 extends through a rectangular opening 89 in the cam follower lever 78, and the opening 89 has sufficient lateral dimension along a lne perpendicular to the direction of movement of the lever 78 to permit limited rotational movement of the support member 22 relative to the cam follower lever 78. A bearing plate 90 is placed between the undersurface of the support member 22 and the upper surface of the cam follower lever 78 to facilitate relative movement between the two parts.

Rotation of the channel selection shaft 67 to each different detented position provides for the gross or rough tuning of the television receiver to different channels represented by the position of the brush 40 on the corresponding one of the resistive segments 24, 25 and 26. Fine tuning adjustment then is effected by moving the corresponding adjustable cam 74 for that channel inwardly or outwardly under control of a captive cam adjustment screw 92 (shown most clearly in FIGS. 9, 11 and 12). With an adjustable cam 74 moved by operation of the cam adjustment screw 92 to its outermost position (right-most position as viewed in FIG. 12), the adjustable cam 74 is withdrawn its maximum distance from the center of the channel selection shaft 67. In this position, the cam follower lever 78 is permitted to move to its most extended position, as illustrated in FIG. 14, pulling the post 87 upwardly (as viewed in FIG. 14). This causes rotation of the support member 22 in a clockwise direction (as viewed in FIG. 14) to adjust the relative position of the brush 40 on the resistive segment 24, 25 or 26 which it is engaging to one extreme of the fine tuning adjustment position for the selected detented position of the potentiometer wiper 40.

Figure 12:
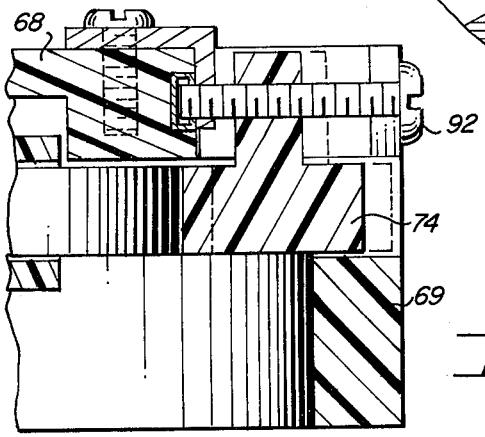
FIG. 12 is a cross-sectional view of a portion of the assembly of FIG. 9.

Similarly, when the adjustable cam 74 for the selected channel is moved under control of the cam adjustment screw 92 to its extreme innermost position (closest to the center of the axis of the channel selection shaft 67, or farthest to the left as viewed in FIG. 12), the cam follower lever 78 is moved to the position shown in FIG. 15. In this position, the support member 22 is moved in a counter-clockwise direction as illustrated in FIG. 15.

Intermediate adjustments of the adjustable cams 74 result in intermediate locations of the cam follower lever 78 between the two extreme positions which are illustrated in FIGS. 14 and 15. These movements cause the cam follower lever 78 to push or pull the fine tuning adjustment post 87 against the urging of the spring 80 to effect the desired rotation of the support member 22 to make the necessary fine tuning adjustments of each detented position of the channel selection shaft 67.

To facilitate the sliding movement of the cam follower lever 78 and the slight rotational movement of the support member 22, grooves 94 and 96 are provided for guiding small balls which rotate against the mating surfaces of the next lower element in the assembly. This results in nearly friction-free reciprocating travel of the cam follower lever 78 and rotational movement of the support member 22.

In the assembly shown in FIGS. 9 through 15, the contacts 28 and 38 are wiper or brush contacts similar to the wiper 40 and engage the enlarged conductive areas 30 and 34 formed on the support member 22 (see FIG. 1) to insure electrical contact to these areas throughout the full range of relative rotational fine tuning adjustments of the support member 22.

While the assemblies which have been described thus far will adequately and effectively permit tuning to any channel in any of the bands to which the television receiver can be tuned, they both have the disadvantage of requiring individual screwdriver adjustments or the like for making the fine tuning settings for each of the channel selection positions. It is preferable for a television receiver to be capable of fine tuning without the necessity for using a separate tool such as a screwdriver to make the adjustment. The embodiment shown in FIGS. 16 through 20 does not require such separate tools for fine tuning adjustments.

In the embodiment of FIGS. 16 to 20, a support member 100 for the arcuate resistive segments is similar to the support member 22 shown in FIG. 2. The resistive segments 124, 125 and 126 also correspond to the segments 24, 25 and 26, respectively, of FIG. 2. A pair of input terminals 130 and 134 supply direct current operating potential across the resistive segments 124, 125 and 126. These terminals are comparable to the conductive areas 30 and 34 of the subassembly shown in FIG. 2.

In addition to the resistive segments 124, 125 and 126 for the three different bands of television signals, there are three corresponding conductive arcuate segments 127, 128 and 129 on a smaller circle for operating as a band select switch to provide the signals over the band switch leads 20 shown in FIG. 1. These band select conductive segments 127, 128 and 129 are located 180° from the resistive segments with which they correspond and each has the same number of degrees of arc as its corresponding resistive segment. For example, the band select conductor segment 129 is effective to control the band switching of the tuner 10 whenever the tuning voltage is obtained from the resistive segment 26. The band select segment 127 is effective whenever the resistive segment 124 supplies the tuning voltage and the band select conductive segment 128 is effective at the time the resistive segment 125 supplies the tuning voltage. A band select common output terminal 130 is interconnected by a band switch contact brush pair 132, 133 (FIGS. 17 and 20) to supply a band switching potential from supply terminal 131 to the selected band switching conductive segment 127, 128 or 129 which is engaged for the channel to which the receiver is to be tuned.

To obtain the tuning voltage for the selected channel, an individual contact wiper 135 (FIGS. 17, 18 and 20) in the form of a generally U-shaped spring has one end engaging a section of the resistive segment 124, 125 or 126 with which it is associated. The other end engages an elongated channel switch contact conductor 136 for each different channel position to which the assembly can be tuned. Each contact wiper 135 is attached to the lower end of a contact holder 138 which has a rack gear on its top and which is guided in an elongated groove formed in a non-conductive guide plate 145 overlying the contact conductor segments 136 on the support member 100. The grooves in the guide plate 145 determine the limits of travel of the contact wiper 135 between the solid line position and the dotted line position shown in FIG. 17.

As in the previous examples which have been discussed, the contact wipers 135 for adjacent channels overlap common resistances on the resistive segments 124, 125 and 126 which they engage to permit the full range of voltages which are capable of being obtained from the resistive segments 124, 125 and 126 to be supplied to the contact conductors 136. This means that there are no gaps in the tuning voltages which can be obtained from the channel selector assembly using the subassembly shown in FIGS. 16 and 17.

For the UHF channels, since 12 channels are shown as being capable of preset tuning at any one time, each contact wiper 135 must be capable of sweeping a range of resistances on the resistive segment 125 which varies sufficiently to produce tuning voltages capable of spanning six different UHF channels. The particular one of these six channels to which each position is to be tuned then is individually determined at the location in which the receiver is operated.

Figure 16:
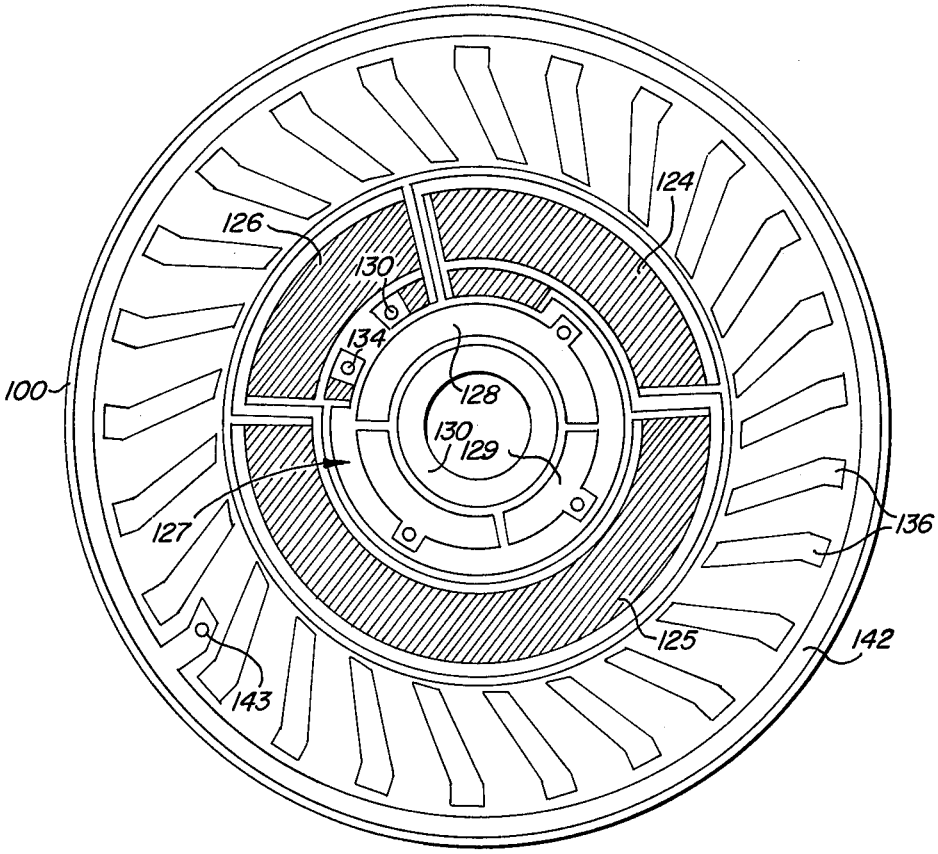
FIG. 16 shows another embodiment of a resistive element and switch contact assembly for use in potentiometer assemblies made in accordance with another embodiment of the invention.
Figure 17:
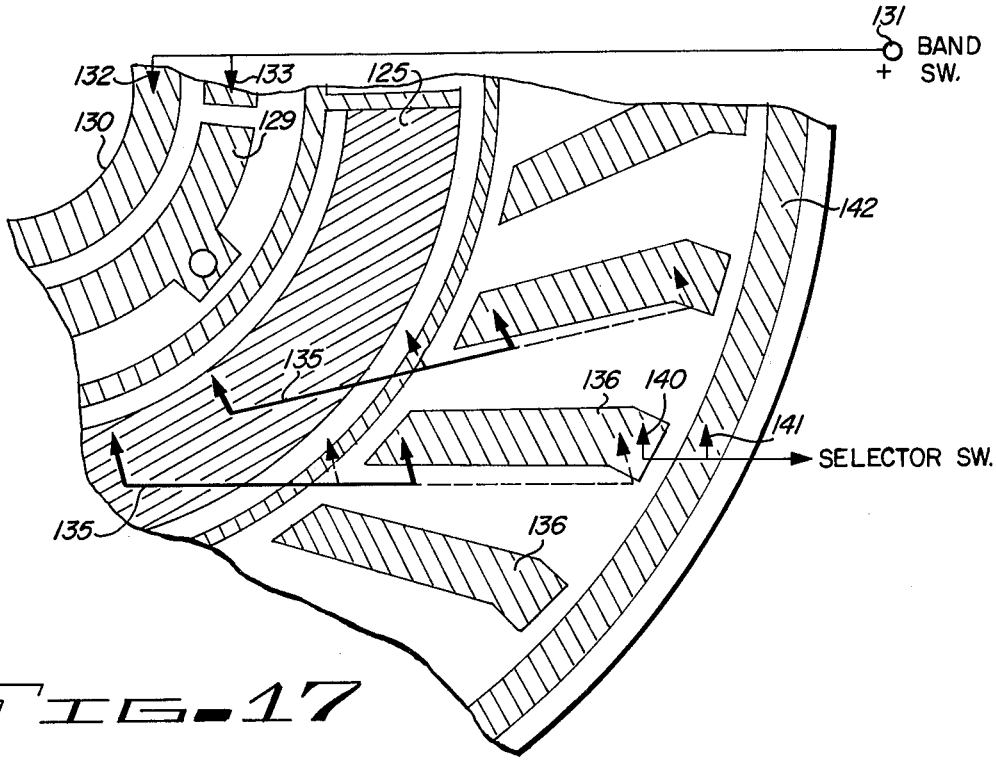
FIG. 17 shows details of the structure of FIG. 16, illustrating the manner in which switch contacts engage the various portions of the element of FIG. 16.
Figure 1B:
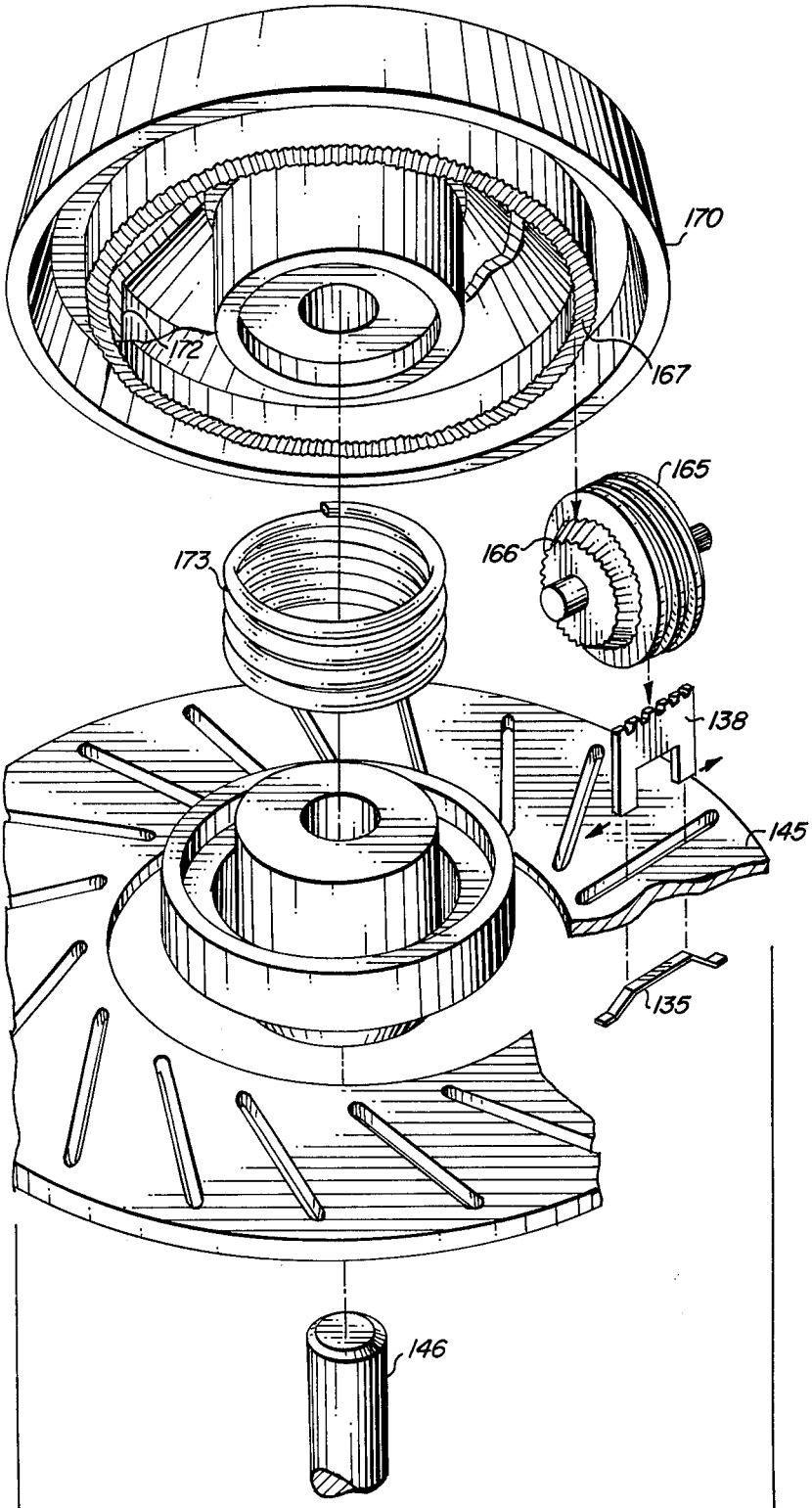
Figure 20:
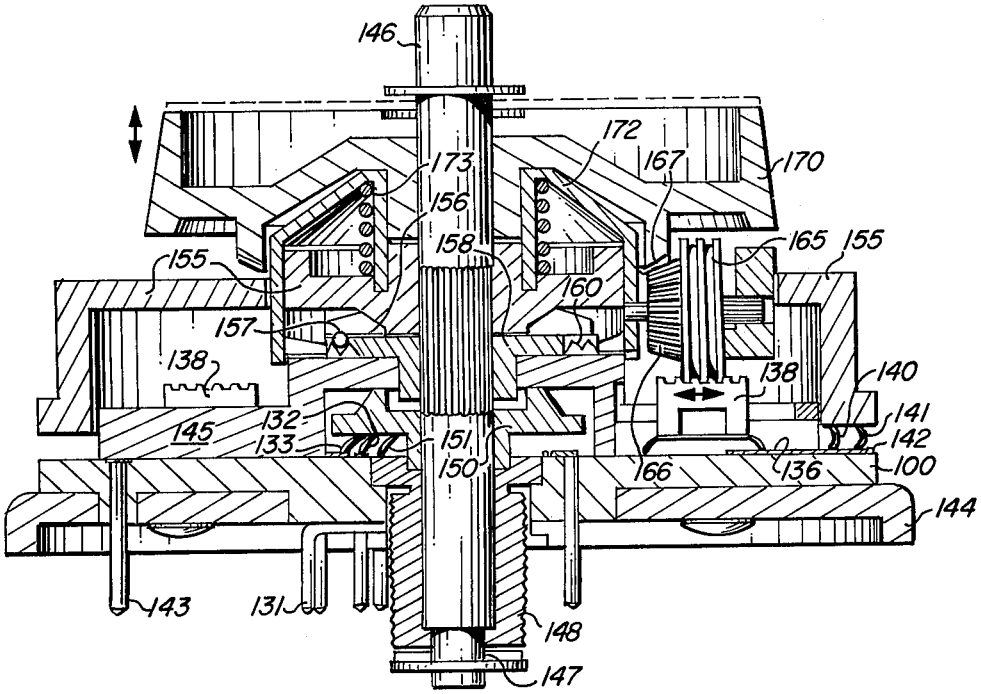

A channel selector switch is provided in the form of a pair of conductively interconnected wipers 140 and 141, shown in FIGS. 17 and 20. The wiper 140 engages the particular channel switch contact conductor 136 associated with the channel to which the receiver is to be tuned. The wiper 141 engages a common channel switch contact conductor 142 which is deposited on the upper surface of the support member 100 as shown in FIG. 16. This common conductor 142 has an output terminal connection 143 which supplies the selected tuning voltage to a lead 19 shown in FIG. 1.

Figure 19:
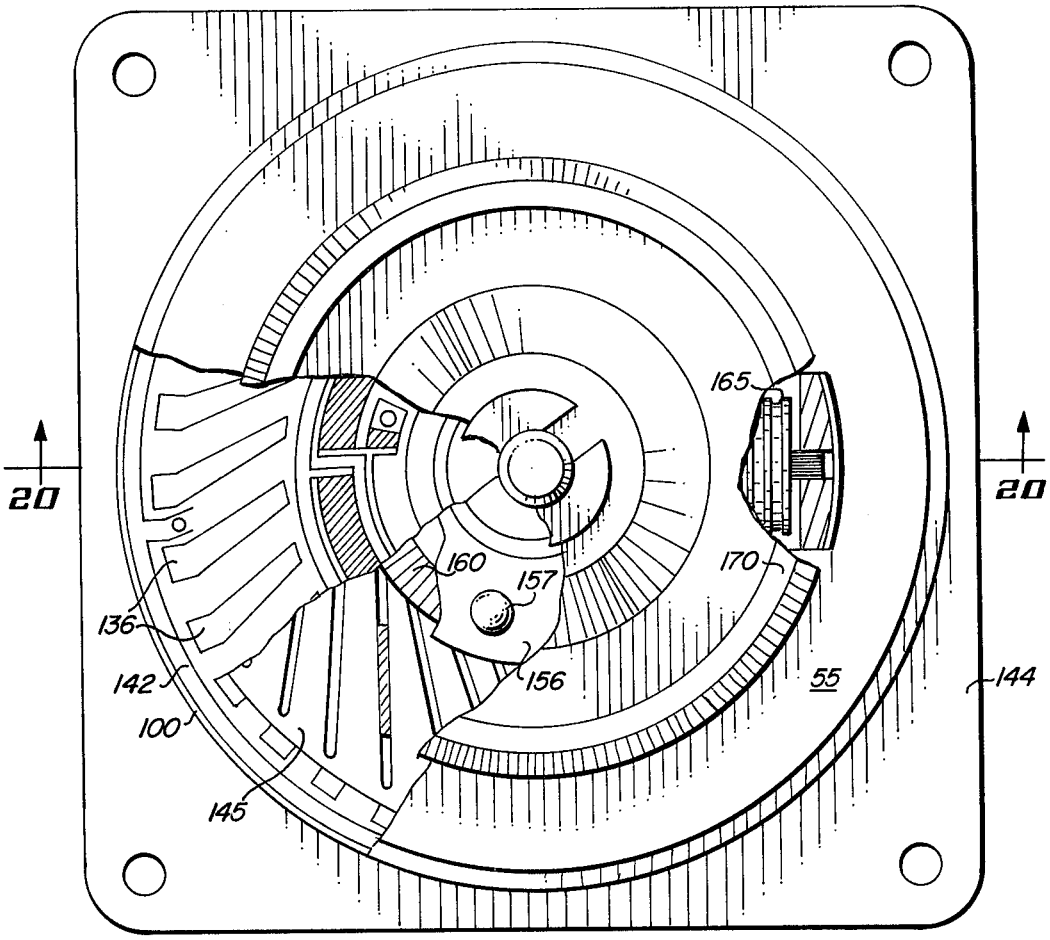
FIGS. 19 and 20 are a partially cutaway top view and a cross-sectional view, respectively, of a preferred embodiment of the invention using the parts shown in FIGS. 16, 17 and 18.

Referring more particularly to FIGS. 18, 19 and 20, the channel selector mechanism using the subassembly of FIGS. 16 and 17 is shown in greater detail. A base member 144 for mounting the assembly is attached to a suitable point in the television receiver chassis with which the assembly is to be used. The support member 100 of FIG. 16 is rigidly attached to the base member 144. The guide plate cover 145 then is attached to position over the support member 100 to align the slots in the guide plate 145 with the center lines of the channel switch contact conductive segments 136. The contact holders 138 are frictionally engaged by the edges of the slots in the guide plate 145 and by the pressure of the spring-biased contact wipers 135 to pre-established positions within the slots used to guide each contact holder 138.

A tuning shaft 146 is mounted on a suitable support bearing 147 for free rotation within a band switch contact bushing 148 made of conductive material. The shaft 146 has a contact wiper assembly 150 attached to it for rotation, and this wiper assembly carries the wipers 132 and 133. These wipers are electrically connected in common with a wiper 151 which engages a surface on the conductive band switch contact bushing 148. The bushing 148 also is connected to the band switch terminal 131, so that the wiper 133 supplies the band switching potential to whichever one of the band selection conductive segments 127, 128 or 129 is engaged by the rotational position of the tuning shaft 146.

Channel selection is effected by rotation of the tuning shaft 146 to rotate a channel selector switch housing member 155 splined to the tuning shaft 146. The contact brushes 140 and 141 are carried by the lower edge of the member 155 for rotation therewith.

Detented tuning to each of the different positions on a step-by-step basis from one channel switch contact conductor 136 to the next is controlled by a circular detent spring 156, which carries a detent ball 157 in an aperture in the spring 156 slightly smaller than the diameter of the ball 157. A spring holder member 158 is attached to the shaft 146 and clamps the spring 156 against a mating surface of the member 155, as shown most clearly in FIG. 20. The ball 157 then is moved to rest between adjacent detent teeth 160 which are formed on a surface of the guide plate 145, as shown most clearly in FIG. 20.

When the tuning shaft 146 is rotated to the position indicative of the desired channel, a fine tuning adjustment worm gear 165 is located directly above the contact holder 138 used to fine tune the selected channel. The worm gear 165 also is integrally formed with a pinion gear 166, which is engaged by a fine tune adjustment gear 167 carried on the underside of a fine tune adjustment knob 170 mounted for free rotation about the shaft 146. A tuning gear bearing 172 in the member 155 is urged upwardly under the action of a compression spring 173 against the underside of the knob 170. The bearing 172 carries the worm gear 165, rotatably mounted in the bearing 172, upwardly out of engagement with the rack gears on the top of the contact holders 138.

If fine tuning adjustment of the contact holder 138 located beneath the worm gear 165 is desired for the selected channel, the fine tune adjustment knob 170 is depressed downwardly to the position shown in FIG. 20 from the dotted line position to mesh the worm gear 165 with the rack gear on the top of the contact holder 138. Rotation of the knob 170, when it is in this depressed condition, then causes rotation of the worm gear 165 through the pinion gears 166 and 167 to move the contact holder 138 under engagement in either direction in the slot in the guide plate 140 to effect the desired fine tuning adjustment. When the adjustment is completed. release of the knob 170 permits it again to be biased upwardly under the action of the spring 173, disengaging the gear 165 from the contact holder 138.

In this matter, each different channel is first selected by each detented position of rotation of the tuning shaft 146. Fine tuning for each selected channel then is effected by depression and rotation of the fine tuning knob 170 in the manner described.

The guide slots in the plate 145 for the contact holders 138 are arranged to cause the wipers 135 to move linearly along lines tangential to a circle which is concentric with the circle formed by the resistive segments 124, 125 and 126. The radius of the circle used to define the paths of travel of the wipers is less than the radius of the circle formed by the outermost edge of the resistive segments. This permits adjacent wipers 135 to overlap common resistances on the segments 124, 125 and 126 without mechanical interference.

The voltages supplied to the band select switch segments, the channel switch contact conductor common connector 142, and the terminals 130 and 134 all may be taken from appropriate contact pins connected to them as shown extending downwardly from the bottom of the base member 144.

The assembly shown in FIGS. 16 through 20 may be manufactured as a very compact assembly requiring less space within the chassis of the television receiver than the turret-type tuners presently employed. Once the fine tuning adjustments for each of the channels have been preset in accordance with the techniques described, it generally is not necessary to reset the fine tuning adjustments for a considerable period of time. Channel selection for any VHF or UHF channel then merely is effected by rotating the tuning shaft 146 to display the desired channel, at which time the channel selector switch brushes 140 and 141 interconnect the selected channel with the voltage controlled tuner sections 10 of the receiver to effect electronic tuning.

Although several different embodiments have been described in illustrating the potentiometer assemblies of this invention, these embodiments are not to be considered limiting but merely as illustrative of the true scope of the invention.

We claim:

1. An adjustable potentiometer assembly including in combination:

a multiple-segment, resistive element in said potentiometer assembly;

means for applying direct current operating potential across each segment of said resistive element;

adjustable tap means having at least one tap member mounted in said potentiometer assembly for selecting any desired voltage from any of said segments of said resistive element out of the full range of voltages each segment is capable of producing by locating said tap member in contact with the surface of a resistive segment at different points from which the desired voltage is available;

means for adjusting the relative physical positions of said tap member and said resistive element over a predetermined range to obtain voltage adjustments at each of said different points over a second range of voltages which is less than said full range of voltages, the extremes of said second range of voltages at each different point overlying opposite extremes of the second range of voltages at points adjacent to such point; and means coupled with said tap member for providing an output voltage from said adjustable potentiometer assembly.

2. An adjustable potentiometer assembly including in combination:

a multiple segment resistive element fabricated in the form of a circular arrangement of arcs of resistive material, each arc thereof forming a different segment of said resistive element, and an insulating support member to which said resistive material is attached;

means attached to the insulating support member for applying direct current operating potential across each segment of said resistive element;

adjustable tap means having at least one tap member mounted in said potentiometer assembly for selecting any desired available voltage from any of said segments of said resistive element out of the full range of voltages each segment is capable of producing by locating said tap member in contact with the surface of a resistive segment at the point from which the desired voltage is available;

means for adjusting the relative position of said tap member and said resistive element;

means coupled with said tap member for providing an output voltage from said adjustable potentiometer assembly; and a plurality of arcs of conductive material attached to said insulating support member, each of said arcs of conductive material corresponding with an arc of said resistive material and each of said arcs of conductive material having substantially the same number of degrees of arc thereof as the corresponding arc of resistive material, and means selectively coupled with said arcs of conductive material for indicating the segment of resistive material from which said adjustable tap means is supplying said desired voltage.

3. The combination according to claim 1 wherein said segmented resistive element is fabricated in the form of a circular arrangement of arcs of resistive material, each arc thereof forming a different segment of said resistive element, and an insulating support member to which said resistive material and said means for applying potential thereto are attached.

4. The combination according to claim 1 wherein said adjustable tap means comprises a plurality of adjustable tap members for each segment of said resistive element, each of said adjustable tap members arranged to traverse a predetermined different portion of each segment of said resistive element for obtaining a voltage therefrom variable in a limited range, adjacent ones of said tap members being arranged for overlapping common resistive portions of said resistive element.

5. The combination according to claim 4 further including a plurality of arcs of conductive material, each corresponding with an arc of said resistive material and each having substantially the same number of degrees of arc thereof as the corresponding arc of resistive material, said arcs of conductive material being attached to said insulating support member, and means selectively coupled with said arcs of conductive material for indicating the segment of resistive material from which said adjustable tap means is supplying said desired voltage.

6. A potentiometer assembly capable of producing output voltages from a plurality of preset taps including in combination:

an elongated, resistive element in said potentiometer assembly;

means for applying direct current operating potential across said resistive element;

a plurality of potentiometer tap members mounted in said potentiometer assembly adjacent said resistive element for engagement therewith, each of said tap members arranged to engage a predetermined portion of said resistive element for obtaining a voltage therefrom variable in a limited range relative to the full range of voltage appearing across said resistive element, adjacent ones of said tap members being capable of overlapping common resistance portions of said resistive element; and means in said assembly for coupling said tap members with an output terminal.

7. The combination according to claim 6 wherein said resistive element comprises a strip of resistive material having a length greater than its width, and at least some of said tap members are adjustable tap members pivotally mounted at one end on opposite sides of said resistive element and extend from said one end to terminate in a contact portion which engages the surface of said resistive element, said contact portion of said pivotally mounted tap members being movable in circular arcs by pivoting said tap members at said pivot point thereof; and further including means for effecting pivotal adjustment of said tap members.

8. The combination according to claim 6 further including conductive means coupling each of said tap members to a first terminal of a plurality of switch means, each individual to a different one of said tap members, each of said switch means having a second terminal and contact means for interconnecting the first terminal thereof with said second terminal to produce a voltage on the second terminal thereof corresponding to the voltage at the contact portion of said tap member connected thereto.

9. The combination according to claim 8 wherein said resistive element comprises a plurality of flat resistive element segments each having a predetermined number of tap members associated therewith, and further including means common to each of said resistive segments for producing an output signal indicative of the connection of any of the tap members associated therewith with a second terminal of any switch means associated with any tap member on such segment.

10. The combination according to claim 8 wherein the means for connecting first and second terminals of each of said switch means comprises a push-button switch completing a conductive path between the first and second terminals of a selected switch means.

11. The combination according to claim 10 wherein said switch means comprises an individual push-button switch for each of said tap members.

12. An adjustable potentiometer assembly for deriving tuning voltages for a multi-band radio frequency receiver, such as a television receiver, comprising in combination:

a base member for said potentiometer assembly;

an insulating support member mounted for limited rotational movement about a central shaft opening therein on said base member;

a plurality of arcuate resistive elements mounted on said support member concentrically about the opening therein, each of said resistive elements corresponding with a predetermined frequency band capable of receipt by said receiver, said resistive elements each having a predetermined width;

means for applying a direct current potential across each of said elements of resistive material;

a control shaft rotatably supported by said base member and extending through the opening in said support member;

a detented rotary selector member attached to said shaft and carrying thereon a brush member rotatably movable therewith for engaging said resistive elements as said selector member is rotated to different detented positions;

adjustable cam surface members on said rotatable selector member for effecting fine tuning adjustments at different detented positions thereof;

cam follower means coupled with said support member and engaging said cam surfaces for effecting limited rotation of said support member, and therefore said resistive elements, relative to said base member and said selector member in accordance with the cam surface presented thereto.

13. The combination according to claim 12 wherein said cam follower means and a means for detenting said selector member are combined in a unitary assembly.

14. The combination according to claim 13 wherein said selector member is substantially in the form of an open-ended cylinder, having depending sides, on the inner surface of which are located said adjustable cam surfce members, with said cam surface members being movable radially toward and away from said shaft to which said selector member is attached, and said cam follower means is spring-biased into engagement with said cam surface members and moves radially toward and away from said shaft under control of sad cam surface members and further includes means for converting the reciprocating linear motion thereof to rotary motion of said support member relative to said base member.

15. An adjustable potentiometer assembly for deriving tuning voltages for a multi-band radio frequency receiver, such as a television receiver, comprising in combination:

a base member for said potentiometer assembly;

a substantially circular insulating support member mounted on said base member;

a plurality of arcuate resistive elements mounted on said support member in a circle having its center at the center of said support member, each of said resistive elements corresponding with a predetermined band of frequencies capable of receipt by said receiver, said resistive elements each having a predetermined width defined by inside and outside edges of different radii;

means for applying a direct current potential across each of said resistive elements;

a plurality of potentiometer wiper elements mounted in said assembly and each having one end thereof in contact with the surface of one of said resistive elements, said wiper elements each being mounted for movement linearly along paths tangential to circles concentric with said resistive elements, such circles having a radius less than the radius of the outside edge of said resistive elements, adjacent ones of said wiper elements being arranged for overlapping electrically common portions of said resistive elements to permit selection of overlapping output voltages therefrom; and means for adjusting the positions of said wiper elements relative to said resistive elements along said paths.

16. The combination according to claim 15 further including an output terminal and selector switch means having a plurality of contacts each arranged for electrical connection with a respective one of said wiper elements, and a movable contact arm coupled with said output terminal and engageable with said contacts for providing an output voltage thereon from said adjustable potentiometer assembly.

17. The combination according to claim 16 wherein said selector switch means includes additional contact means for frequency band selection.

18. The combination according to claim 16 further including an adjusting device operatively associated with said selector switch means to adjust the liner location of a selected wiper element to a resistance value on the resistive element contacted thereby to a resistance value corresponding to a tuning voltage corresponding to a selected frequency for tuning said receiver; and means operable for coupling said adjusting device mechanically to the wiper element coupled with said output terminal by said movable contact arm of said selector switch means.

19. The combination according to claim 18 wherein each of said plurality of contacts of said selector switch comprises an elongated contact disposed along one of said tangential paths adjacent said arcuate resistive elements, and said wiper elements each comprise a conductive element having a first end engaging the surface of a resistive element and a second end engaging an associated elongated contact, said elongated contacts being separated electrically from said resistive elements by said support member, said wiper elements further having adjustment means attached thereto for establishing the linear position thereof.

20. The combination according to claim 19 further including a guide plate mounted in said potentiometer assembly in a fixed relationship above the surface of said support member and having linear guide slots formed therethrough for accommodating said wiper element adjustment means, said adjustment means extending through said guide slots above the surface of said guide plate for engagement with said adjustment device.

21. The combination to claim 20 wherein the surface of each of said adjustment means extending through said guide plate comprises a rack gear, and said adjusting device comprises a worm gear normally spring-biased out of engagement with said rack gears of said adjustment means, and further including means for selectively engaging said worm gear with said rack gear of said adjustment means and for effecting rotation of said worm gear to adjust the linear position of a wiper element, the adjustment means of which is engaged by said worm gear.

* * * * *

UNITED STATES PATENT AND TRADEMARK OFFICE

CERTIFICATE OF CORRECTION

PATENT NO. : 4,050,050

DATED : September 20, 1977

INVENTOR(S) : Mutsuo Nakanishi et al.

It is certified that error appears in the above-identified patent and that said Letters Patent are hereby corrected as shown below:

Column 11, Claim 1, Line 43:

After "desired" insert --available--;

Column 14, Claim 14, Line 18:

"surfce" should be --surface--;

Column 16, Claim 21, Line 12:

After "combination" insert --according--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*